United States Patent [19]

Casdas

[11] 4,435,255

[45] Mar. 6, 1984

[54] PROCESS AND APPARATUS FOR CONTROLLED FEED OF ALUMINA AND HALOGEN ADDITIVES INTO ELECTROLYSIS VATS FOR THE PRODUCTION OF ALUMINUM

[75] Inventor: Spyridon Casdas, Paralia Distomon, Greece

[73] Assignee: Aluminium de Grece, Athens, Greece

[21] Appl. No.: 366,990

[22] Filed: Apr. 9, 1982

[30] Foreign Application Priority Data

Apr. 15, 1981 [FR] France ..... 81 07855
Dec. 8, 1981 [FR] France ..... 81 23328

[51] Int. Cl.[3] ..... C25C 3/06; C25C 3/14; C25C 3/20

[52] U.S. Cl. ..... 204/67; 204/245; 204/246

[58] Field of Search ..... 204/67, 245

[56] References Cited

U.S. PATENT DOCUMENTS 3,135,672 6/1964 Hirakawa et al. ..... 204/67
4,321,115 3/1982 Rebmann et al. ..... 204/67
4,332,660 6/1982 Friedli et al. ..... 204/67

*Primary Examiner*—Howard S. Williams
*Attorney, Agent, or Firm*—Dennison, Meserole, Pollack & Scheiner

[57] ABSTRACT

The invention concerns a process and a device for controlled feed of alumina and halogen additives into a vat for production of aluminum by alumina electrolysis according to the Hall-Héroult technique.

The alumina or the halogen additive, set aside by gravity into the storage means, is introduced into a volumetric feed regulator and dispatched under the effect of a jet of compressed air, as far as the orifice of introduction into the electrolysis vat, through a rigid system of pipes, in successive equal or unequal dosed quantities, at constant or variable time intervals. The device includes no moving piece which is subject to wear or abrasion.

16 Claims, 3 Drawing Figures

PROCESS AND APPARATUS FOR CONTROLLED FEED OF ALUMINA AND HALOGEN ADDITIVES INTO ELECTROLYSIS VATS FOR THE PRODUCTION OF ALUMINUM

The present invention concerns a process and an apparatus for the controlled feed of alumina and halogen additives into vats producing aluminum by fiery electrolysis of alumina dissolved in molten cryolite according to the Hall-Heroult process.

Until recent times, the alumina was fed in by placing it on the congealed electrolysis skin covering the vat and by periodically breaking this skin by means of picks, which caused the alumina to drop into the bath in large and poorly controlled quantities.

Such processes have been described, for example, in French Pat. Nos. 1 245 598, 1 526 766, 2 036 896 in the name of PECHINEY (corresponding respectively to U.S. Pat. Nos. 3,216,918, 3,372,106, 3,679,557).

Now attempts are being made to carry out the alumina feed in a controlled and uniform manner, so as to constantly maintain the concentration of alumina in the electrolyte in a predetermined range, so as to obtain the best possible yield.

Such systems have been described, particularly, in French Pat. Nos. 2 099 434 (ALCOA), 2 264 098 (NIPPON LIGHT METALS) and in U.S. Pat. Nos. 3,400,062 (ALCOA) and 3,689,229 (ALCOA). They are generally constituted of a centralized means of alumina storage and by a distribution means to distribute the alumina on the vats, at one or more points, the alumina dosage means being most often combined with the means for piercing the skin of the congealed elctrolyte.

Such feed devices require the placement of the feed hopper at a sufficiently high level in relation to the cell to assure the alumina flow by gravity. Moreover, for the same reason, the hopper must be placed in proximity with the cell.

These devices are not well adapted for reduction of the size of the installations and for transformation into automatic and controlled feed of the existing cells which are fed, in a traditional manner, by piercing of the skin.

Besides, they include mechanical devices which are subject to frequent breakdowns and to rapid wear as a result of the abrasive effect of the alumina.

As for the addition of the halogen, chlorine and/or fluorine additives, intended to compensate the normal losses in the course of electrolysis, or to correct the composition of the electrolyte, to act on its melting point or its electric conductivity or its capacity to dissolve alumina, it continues to be carried out by massive additions (30 to 50 kg, for instance) at relatively lengthy time intervals, which causes inconveniences comparable to those of the massive and uncontrolled addition of alumina:

disturbance of the electrochemical equilibrium of the vat, "sawtooth" operation, between abrupt excess and low concentration of the fluorine additive. Moreover, the quantity of additive to be introduced is often determined from analysis and calculation which are not always totally satisfactory. Finally, the manual additions are an arduous operation for the personnel;

disturbance of the alumina feed, which must be interrupted during these a additions.

The object of the invention is an alumina feed process and a feed process of halogen additives and, particularly: aluminum, calcium, magnesium, lithium, sodium chloride, cryolite, alkaline and earth alkaline chlorides, into the electrolysis vats for the production of aluminum by the Hall-Heroult process, while using the orifice or at least one of the orifices held open in the skin of congealed electrolyte for the feed of alumina without modification by the pick device, for this introduction.

This process consists of setting apart the alumina or the halogen derivative in at least one storage means which, at its bottom, has a flow orifice provided with a cutoff means and a means to feed said alumina or halogen additive in successive doses through a system of pipes, into at least one orifice in the skin of congealed electrolyte which covers the vat in normal operation, the process including the following operations in succession:

The cutoff means is opened.

The alumina or halogen additive is allowed to flow into the feed regulator by gravity.

The cutoff means is closed.

Compressed air is injected at the base of the feed regulator through it and into the axis of the system of pipes, until all of the alumina or all of the halogen additive contained in the feed regulator has been transmitted through said system of pipes, to the orifice of the skin of electrolysis.

Preferably, this is followed by an injection of compressed air into the storage means to accelerate the flow of the alumina or the halogen additive into the feed regulator.

This injection of air is effected before the end of the filling of the feed regulator, at the bottom of the storage means and in proximity to the flow orifice.

Another object of the invention is a device to carry out the process of feeding alumina and halogen additives into a vat for production of aluminum, having, in combination:

a means for storage of the alumina or halogen additives possessing at its bottom a flow orifice provided with a controlled cutoff means.

a volumetric feed regulator of constant or adjustable volume, of which the top part is connected to the cutoff control means and to a gas extraction orifice and of which the bottom part is connected, first to a system of pipes for dispatch of the alumina toward the electrolysis vat, the beginning of this system of pipes being oriented radially, and the second to a means for injection of compressed air opening into the feed regulator, opposite the beginning of the system of pipes, the axis of the air injection means and the axis of the beginning of the system of pipes being essentially convergent.

The orifice for gas extraction from the feed regulator is connected to the beginning of the system of pipes for dispatch of the alumina.

The connection between the orifice for gas extraction from the feed regulator and the beginning of the system of pipes for dispatch is realized preferably of a transparent or translucent material.

The controlled cutoff means is a pneumatic valve with retractable inside sleeve.

The connection between the storage means and the feed regulator is preferably flexible—e.g. a rubber sleeve—which allows the realization of the system of pipes for dispatch, entirely of rigid material, for example of steel tubing.

Figure 1:
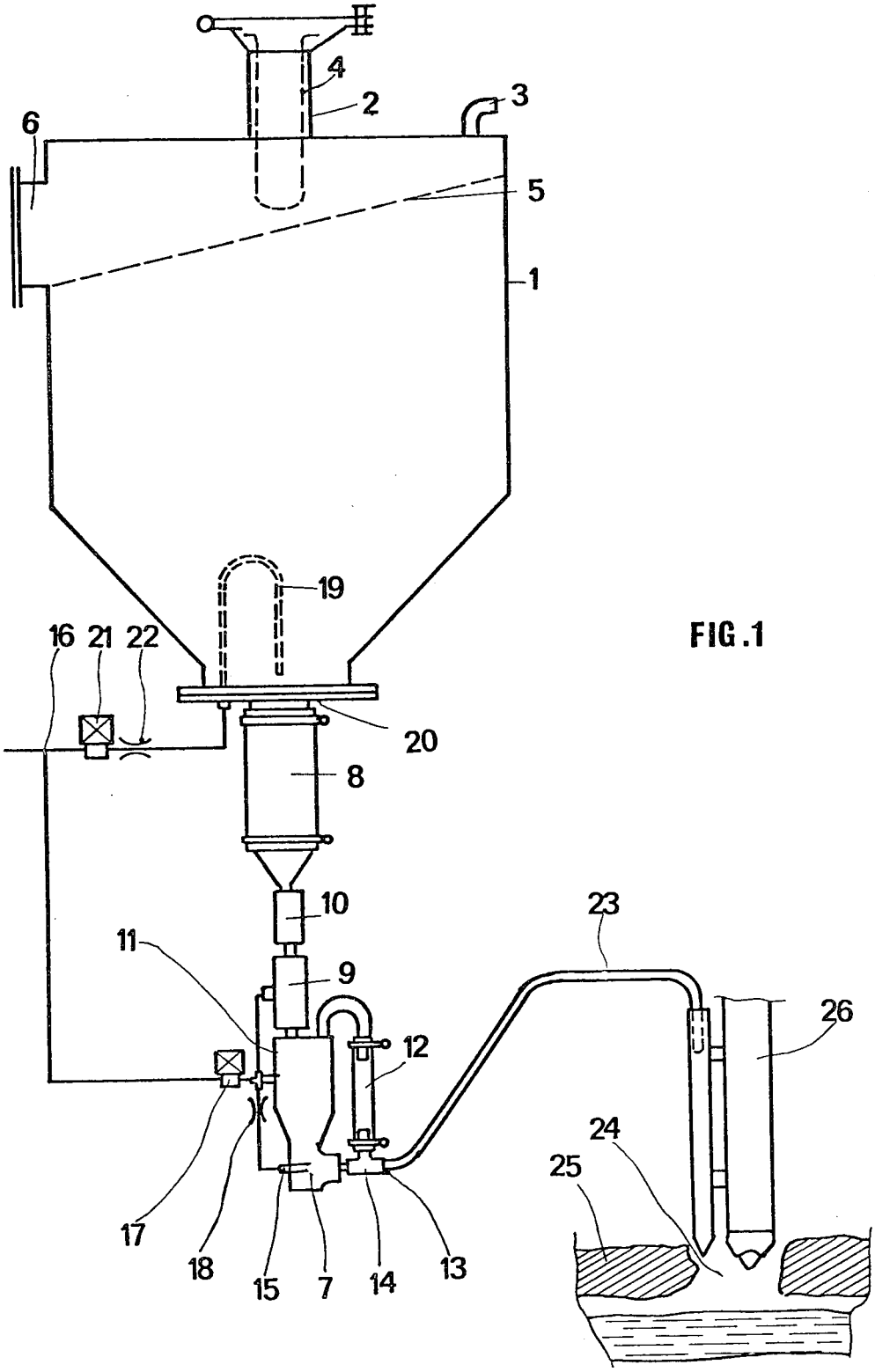
FIG. 1 is a diagram of the assembly of the feed device.
Figure 2:
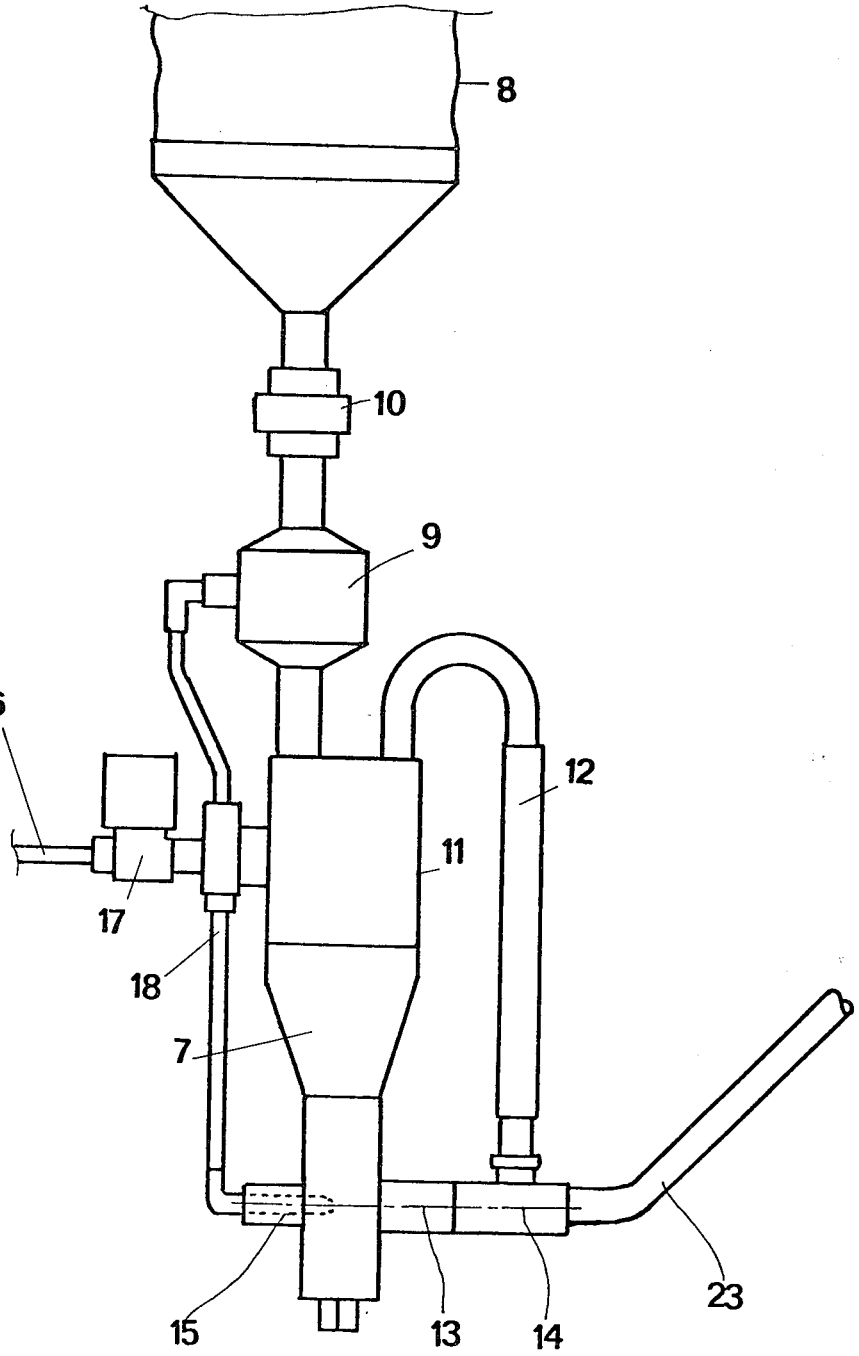
FIG. 2 shows the feed regulator.

The alumina or halogen additive is stored in a hopper 1 provided with a filling orifice 2 and a gas extraction tube 3; it is often preferable to provide, at the top, either a removable grill filter 4 placed in the filling orifice, or a stationary grill 5, tilted, which can be cleaned through an inspection hole 6, to stop the particles greater than 3 millimeters which would disturb the operation of the feed regulator.

The hopper is connected to the volumetric feed regulator 7 through a flexible tube 8 of large diameter (e.g. 50 to 100 mm). In this manner, the feed regulator is mounted flexibly, which allows use of flexible tubes between the feed regulator and the electrolysis vat to be avoided, in a zone where the wear and the risks of damage are greatest.

The volumetric feed regulator 7 is connected to the discharge of flexible tube 8 through the pneumatic valve 9 with retractable flexible inside sleeve, e.g. a DOSAPRO (TM pending) valve, and a rapid coupler 10 of any known type.

Feed regulator 7, which is the volumetric type, has a metallic body 11 of which the top part is connected to the discharge or pneumatic valve 9 as well as to the top part of a gas extraction tube 12 which is advantageously realized of transparent or translucent material and of which the bottom part is connected to the discharge from the feed regulator and to the beginning 13 of the system of pipes for dispatch 23 by a T-shaped coupling 14.

During the filling of feed regulator 7, the air escapes through tube 12 and is evacuated through the system of pipes for dispatch 23.

The third arm of the T-coupling opens in the bottom part of feed regulator 7 opposite and in the same axis with an injector 15, preferably of stainless steel.

Injector 15 is fed with compressed air under 5 to 6 bars pressure from a principal system of pipes 16, through a solenoid valve 17 and a diaphragm 18. The same solenoid valve 17 controls the pneumatic valve 9 through a shunt upstream from diaphragm 18. This assembly allows for rapid opening of pneumatic valve 9 at the end of the cycle, by evacuation of the compressed air—which held it closed—through diaphragm 18.

Hopper 1 also has a system of pipes 19 for introduction of filling air, elbowed and opening in the proximity of the bottom orifice 20. The system of pipes 19 is fed with compressed air through solenoid valve 21 and diaphragm 22. Thus it is possible to accelerate the end of the filling and to shorten the total duration of the cycle.

The system of pipes for dispatch 23 has a length and a shape adapted to the layout of the electrolysis chamber and to the placement of the hopper and of the feed regulator. Its length can be, and can even exceed, about fifteen meters. It is necessary to avoid sharp elbows. Because of the flexible connection [sleeve 8] between the hopper and the feed regulator, there is no problem if the assembly of the system of pipes 23 is entirely rigid and is realized for example of steel tubing, which makes it extremely resistant to the heat in the proximity of the vat and to the shocks to which it can be subject.

The system of pipes opens at the level of an orifice 24 in the skin of congealed salt 25 which, in normal operation, covers the electrolysis vat. Generally, a pick 26 actuated by a pneumatic actuator holds the inlet orifice permanently open. Various devices of known type can release an alarm if the orifice remains blocked despite the action of the pick, and to momentarily interrupt the dispatch of the alumina.

The device operates as follows:

1. Prefilling

Pneumatic valve 9 is opened and the feed regulator begins to be filled by gravity. The alumina is stopped by the effect of the slope at the entry 13 of the dispatch tube 23. The duration of this phase must be on the order of several seconds.

2. Filling

During this phase, the filling solenoid valve 21 is actuated and the filling is accelerated by the introduction of air into the hopper (tube 19). When feed regulator 7 is filled, a certain quantity of alumina gets into the transparent gas extraction tube, forms a plug in the T-connection 14 between gas extraction tube 12 and dispatch tube 23. This plug stops the flow of alumina. The overflow is visible at the level of the transparent tube, which allows verification of complete filling of the feed regulator. The duration of the filling phase is on the order of ten seconds. When the alumina is very fluid, it advances a few centimeters in dispatch tube 23 before its flow is stopped. The height of the alumina column in the transparent gas extraction tube is a sensitive index of the fluidity of the alumina.

3. Discharge

The solenoid discharge valve 17 is actuated, which causes pneumatic valve 9 to close again and to cause the dispatch of the alumina under the effect of the jet of compressed air coming from injector 15. The operation of solenoid discharge valve 17 can be controlled advantageously in synchronization with the command to rise of the actuator for piercing the skin on the electrolysis vat.

Feed regulator 7 is normally emptied in about ten seconds. If the control of the solenoid discharge valve is extended for from 2 to 5 seconds, it is possible to be assured that feed regulator 8 and tubing 23 are completely empty at the end of this phase. In the case wherein the dispatch is stopped before the end of the discharge, by stopping the control or the compressed air feed, the alumina is deposited in the tubing. When the next dispatch is started, a plug of alumina is formed. In this case, the pressure in the feed regulator mounts sufficiently to unplug the tubing. In the case wherein the alumina tube mounted on the actuator is plugged up by projection of the bath or of metal, the feed regulator is emptied but the alumina escapes as a result of the play existing between this tube and the end of the dispatch tube. The good discharge operation can be confirmed at the level of the transparent gas extraction tube, because a part of the dosed quantity passes through this tube.

4. Timing

The feed regulator remains full pending a new discharge command. The duration of this phase can vary as a function of the feed sequence. It suffices that it be longer than approximately 5 seconds so that the alumina is stabilized.

This progression of phases has the advantage of assuring the same filling conditions independent of the feed sequence.

A complete cycle of four phases lasts on the order of about thirty seconds, which allows a rhythm of operation of one hundred dosed quantities per hour.

Besides, the progression of the sequences lends itself perfectly to total automation.

The physical behavior and particularly, the least fluidity of certain halogen additives sometimes requires an adaptation of the device of FIG. 1.

Figure 3:
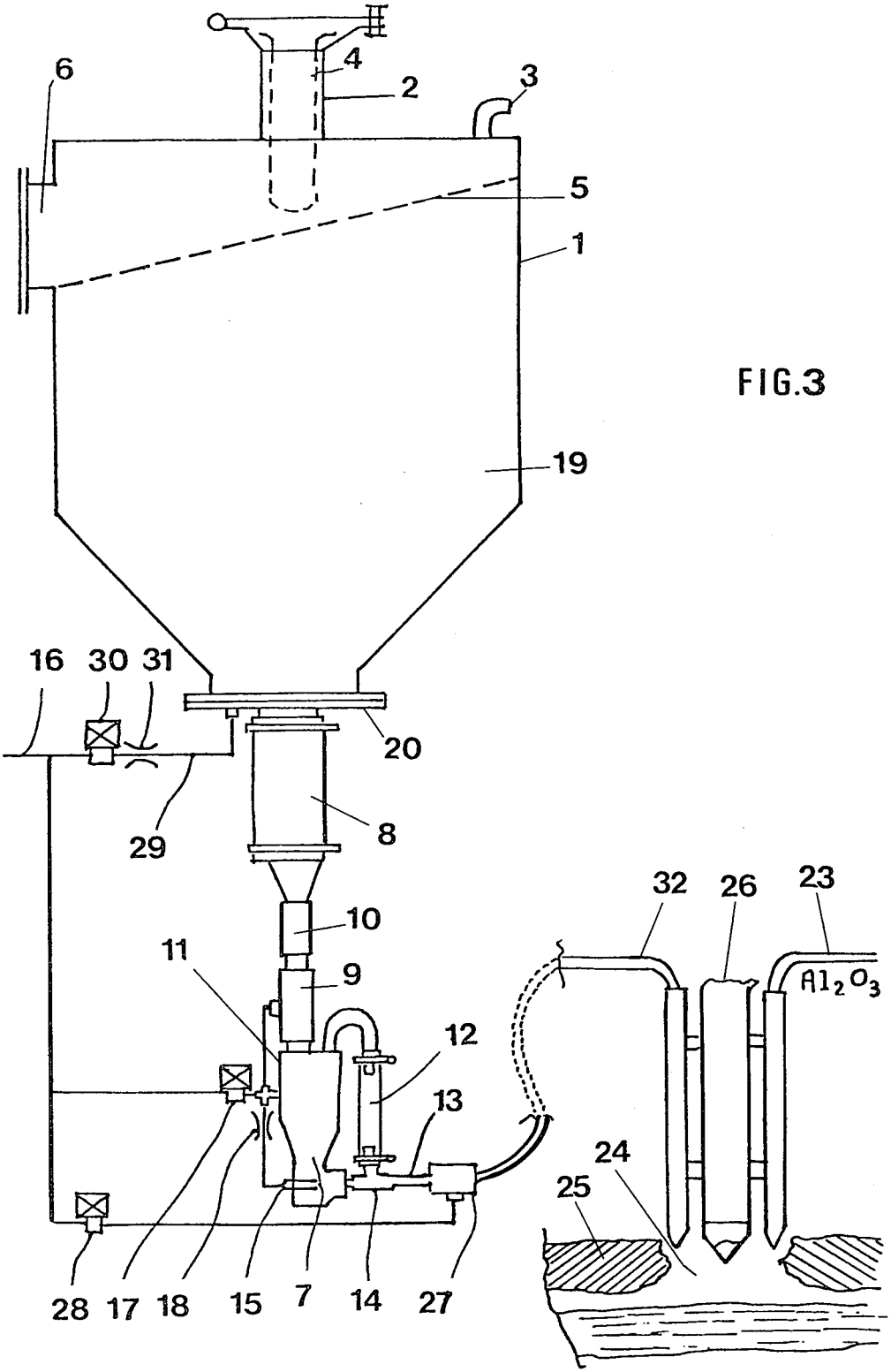
FIG. 3 shows the assembly of the feed device, particularly adapted to the addition of halogen additives.

To assure uniform filling and discharge of the volumetric feed regulator and the dispatch of the halogen additive toward orifice 24 of the electrolysis vat through system of pipes 32, it is possible to proceed with one or more of the following modifications which appear in FIG. 3:

1. Increase of the cross section of the passage by means of controlled cutoff 9 between the storage hopper and the volumetric feed regulator.

2. Placing a controlled cutoff means 27 at the beginning 13 of the system of dispatch pipes 32, such as pneumatic valve with retractable flexible inside sleeve (e.g. DOSAPRO valve—TM pending—) of which the opening is controlled by solenoid valve 28 synchronized with the injection of compressed air at the base of volumetric feed regulator 7, which assures a precise volumetric dosage independent of the halogen additive.

3. Placing in fluidized state, during the filling phase of volumetric feed regulator 7 with the halogen derivative contained in hopper 1 by means of the injection system 29 controlled by solenoid valve 30 and diaphragm 31, in synchronization with the opening of cutoff means 9.

Because of the relatively low additive consumption, it is possible to provide one single hopper, for example of one or two tons capacity of $AlF_3$, for two or more electrolysis vats, either with two or more separate feed regulators, or with one single feed regulator feeding the different vats successively, through a switchover distributor.

The device, object of the invention, lends itself particularly well to the automatic feed of electrolysis vats. If the dosed quantities of alumina or of halogen additive are constant, it suffices that the rhythm of dispatch of each successive dose be modified according to a predetermined program, and as a function of the evolution of the concentration of the electrolyte in alumina and in halogen additive.

But, it is also possible to operate in the opposite manner and to send variable doses of alumina or of halogen additive at a constant rhythm. For that, it suffices to make the volume of the feed regulator variable, for example by controlled deformation of one of its walls of flexible material, such as rubber, or corrugated metal, or controlled introduction into the feed regulator of a body which modifies the volume of the feed regulator, without thus disturbing the filling and discharge.

Thus it is possible to select between a feed of the vat in equal or unequal successive dosed quantities, at uniform or variable time intervals, as a function of the variations of the content of the alumina or halogen additives bath, which gives very great flexibility in the operation of the regulation systems.

EXAMPLES OF APPLICATION TO THE ALUMINA FEED

The device object of the invention has been applied to the automatic and controlled alumina feed of a series of electrolysis vats operating under 70 kA.

Feed regulator 7 has a 1050 gram alumina capacity. Reproducibility tests have shown a dispersion below ±20 grams with the same batch of alumina, and below ±50 grams, over a long period, because of slight variations in the fluidity of the successive deliveries of alumina.

The system of dispatch pipes between the feed regulator and the electrolysis vat has a total length of 4 meters. It is constituted of steel tube of 15 mm interior diameter and 21 mm exterior diameter.

EXAMPLE OF APPLICATION TO THE FEED OF HALOGEN ADDITIVES

Feed regulator 7 was adjusted for a capacity of 1 kg $AlF_3$. Reproducibility tests showed a dispersion below ±20 grams with the same additive, and below ±50 grams over a long period, because of slight variations in the fluidity and the granulometry of the deliveries.

The system of dispatch pipes between the feed regulator and the electrolysis vat has a total length of 4 meters. It is constituted of steel tube of 15 mm interior diameter and 21 mm exterior diameter.

The rhythm of dispatch was fixed at one dose of 1 kg of $AlF_3$ every 500 seconds (approximately 1 hour 32 min).

Among the advantages of the device, object of the invention, it is possible to cite: the precision of forming doses, the simplicity: two solenoid valves and one pneumatic valve, the absence of any movable element which is subject to wear or to abrasion, the absence of any means of fluidisation of the alumina, the possibility of using the system of dispatch pipes of variable level and of great lengths up to 15 meters and even beyond and the possibility of arranging the hoppers and the feed regulators at the most judicious and most accessible level and placement, in order to facilitate control and maintenance.

I claim:

1. Process for feeding alumina and halogen additives into an electrolytic cell for production of aluminum by electrolysis of alumina dissolved in the molten cryolite according to the Hall-Heroult technique, wherein the alumina or halogen additive is in a storage means having a bottom discharge flow orifice, cutoff means for controlling flow from said flow orifice, and a feed regulator for receiving and dispatching successive regulated dose quantities through a system of pipes and into at least one orifice in the crust of solidified electrolyte which covers the cell during normal operation; the process comprising, opening the cutoff means and allowing the alumina or halogen additive to flow into and fill the feed regulator by gravity, closing the cutoff means, and injecting compressed air at the base of the feed regulator through the feed regulator and into the system of pipes until all alumina or halogen additive contained in the feed regulator has been dispatched, through said system of pipes, to the orifice in the electrolysis crust.

2. Process as in claim 1, comprising accelerating the flow of alumina into the feed regulator by injecting compressed air into the storage means.

3. Process as in claim 2, comprising injecting air into the storage means before the end of the filling of the feed regulator.

4. Process as in claim 2 or 3, wherein the injection of air into the storage means is carried out at the bottom part of the storage means, in proximity with the flow orifice.

5. Process as in claim 1, wherein during the flow of halogen additive into the feed regulator, the contents of the storage means are fluidized and maintained fluidized during the entire duration of the filling of the feed regulator, and the further steps of, at the moment of the injection of compressed air at the base of the feed regulator, opening a second cutoff means placed at the discharge of the feed regulator and at the beginning of the system of pipes, maintaining the second cutoff means open until the feed regulator is empty, and closing the second cutoff means immediately thereafter.

6. Process as in claim 1, wherein the dispatch of the alumina or the halogen additive toward the electrolytic cell is carried out in successive equal dose quantities at variable time intervals.

7. Process as in claim 1, wherein the dispatch of the alumina or the halogen additive toward the electrolytic cell is carried out at uniform time intervals, in unequal successive dose quantities.

8. Process as in claim 1, wherein the dispatch of the alumina or the halogen additive toward the electrolytic cell is carried out at variable time intervals, in unequal successive dose quantities.

9. A device for feeding alumina and halogen additives into a cell for production of aluminum, comprising at least one storage means for alumina or halogen additive, said storage means having a bottom with a flow orifice thereat, a controlled cutoff means for said orifice, a volumetric feed regulator having an upper portion in flow receiving communication with the flow orifice, gas extraction means in communication with the feed regulator, said regulator having a lower portion, a system of pipes extending from a point of communication with the lower portion of the regulator to send the alumina or halogen additive toward the electrolytic cell, and means communicating with the lower portion of the regulator in generally opposed alignment with the point of communication of the system of pipes for injection of compressed air into the feed regulator through the regulator and into the system of pipes, and for providing enhanced movement of the contents of the regulator into and through the system of pipes.

10. The device as in claim 9, including means for fluidization of the contents of the storage means and means for controlled blocking of the system of pipes at the point of communication with the feed regulator.

11. The device as in claim 9 or 10, wherein the gas extraction means communicating with the feed regulator also communicates with the beginning of the system of pipes.

12. The device as in claim 11, wherein the gas extraction means includes at least a portion formed of a transparent or translucent material.

13. The device as in claim 9, wherein the controlled cutoff means is a pneumatic valve.

14. The device as in claim 9, including a flexible sleeve connection between the storage means and the feed regulator.

15. The device as in claim 9, wherein the system of pipes for the alumina or the halogen additive is formed entirely of rigid material.

16. The device as in claim 9, wherein the volume of the feed regulator is capable of modification in a controlled fashion.

* * * * *